United States Patent [19]

Naya et al.

[11] 4,210,849

[45] Jul. 1, 1980

[54] ELECTRONIC CONTROL CIRCUITRY FOR TERMINATING FLASH OUTPUT

[75] Inventors: Mikio Naya; Yoshiharu Ohta, both of Izumi; Hiroshi Hosomizu, Osaka, all of Japan

[73] Assignee: Minolta Camera Kabushiki Kaisha, Osaka, Japan

[21] Appl. No.: 30,634

[22] Filed: Apr. 16, 1979

Related U.S. Application Data

[63] Continuation of Ser. No. 802,852, Jun. 2, 1977, abandoned.

[30] Foreign Application Priority Data

Jun. 2, 1976 [JP] Japan ..... 51-64935

[51] Int. Cl.[2] ..... H05B 41/32

[52] U.S. Cl. ..... 315/241 P; 315/151; 354/33

[58] Field of Search ..... 315/151, 159, 241 P; 354/27, 30, 32, 33, 145, 127, 137, 138

[56] References Cited

U.S. PATENT DOCUMENTS

| | | | |
|---|---|---|---|
| 3,710,701 | 1/1973 | Takishima et al. | 315/227 R X |
| 4,012,665 | 3/1977 | Nakamura et al. | 354/145 X |

*Primary Examiner*—Eugene R. LaRoche

*Attorney, Agent, or Firm*—Watson, Cole, Grindle & Watson

[57] ABSTRACT

A semiconductor switching element is connected in series with a flash tube to stop emission of flash light therefrom during operation of the flash tube. A first and a second integrating circuit are parallelly arranged to be connected either alternatively, or both together, with the switching element. The first integrating circuit integrates photo-current generated by a photocell receiving light from an object illuminated by the flash light, and the second integrating circuit integrates current that is manually adjustable. When both integrating circuits are connected with the switching element, the switching element is turned off by that integrating circuit which first reaches a predetermined trigger level.

13 Claims, 3 Drawing Figures

ELECTRONIC CONTROL CIRCUITRY FOR TERMINATING FLASH OUTPUT

This is a continuation, of application Ser. No. 802,852 filed Jun. 2, 1977, abandoned.

BACKGROUND OF THE INVENTION

The present invention relates to electronic flash control devices for measuring the amount of light reflected from a photographic object that is illuminated by flash light, and which interrupts flash firing while the flash tube is in operation when the amount of measured light reaches a given level by actuating a switch element serially connected with the flash tube.

Flash control devices of the above type are known and have been marketed by many manufacturers. For example, U.S. Pat. Re. 28,025 shows such a flash control device in FIGS. 3, 9 and 17 and an explanation of the structure and operation is set forth in the specification, and in particular the description of FIG. 17, beginning at Column 11, line 52, and continuing to Column 12, line 37. In accordance with the teachings of the aforesaid Reissue patent, a brightness output voltage A is compared with a set output voltage B, representing the film sensitivity and lens aperture settings, and when the two voltages are substantially equal, a stop signal pulse is generated, which is provided to the switching circuits illustrated in FIGS. 3, 9 and 17 for the purpose of discontinuing the operation of the flash device.

The switch circuits of FIGS. 3 and 9 are identical and utilize a first silicon controlled rectifier (SCR) connected in series with the flash device and which is controlled by a trigger circuit to enable actuation of the flash device. The stop or blocking signal from a comparator circuit, which compares the aforementioned signals A and B, is applied to the gate of a second SCR which causes current to bypass through a capacitor interconnected between the first and second SCRs so as to turn the flash off by turning the first SCR off.

The flash control circuit in the embodiment of FIG. 17 uses a delay circuit in lieu of the comparator circuits for turning off the flash device. A trigger delay circuit is actuated simultaneously with the actuation of the flash device. The delayed pulse output of the trigger circuit actuates the second SCR to discharge a capacitor connected such that with discharge of that capacitor a reverse current flows through the first SCR. The conduction of the second SCR causes a second capacitor to discharge in a manner to apply a reverse bias to the first SCR for the purpose of shortening the turnoff time thereof.

A flash device provided with such a control device, i.e. either a serially-switch-connected type or a direct stop type, has an advantage that the discharge of the main capacitor is stopped upon actuation of the switch element and the remaining charge in the main condenser is conserved for the next firing of the flash tube. However, if the photographic condition requires a large amount of flash light, for instance when the object to be photographed is distant from the camera, then the remaining capacitor charge is so small that much time is required for charging the main capacitor for the next flash operation. Hence, if photographs are repeatedly taken, for example by means of a motor driven still camera, with short periods or cycles with the above automatically controlled flash device under conditions that require a large amount of light, some pictures may be taken with insufficient flash light or without flash light that results, because the main capacitor, which has discharged a great deal, is incapable of being charged up to a sufficient level to provide an adequate amount of flash light or to fire the flash tube, in the short intervals between flashes.

SUMMARY OF THE INVENTION

It is an object of the present invention to provide an electronic flash control circuit which matches the charging time of a main capacitor with the photographic cycles of high speed continuous photography.

According to the present invention, the amount of light from a flash tube is controlled in terms of the lesser amount between the amount of light measured and a manually set amount of light. As a result, the amount of light from a flash tube may be controlled within a range which has been set manually, in the case where the charging time of a main capacitor is too long, such as in high speed continuous photography.

DESCRIPTION OF THE PREFERRED EMBODIMENTS

Figure 1:
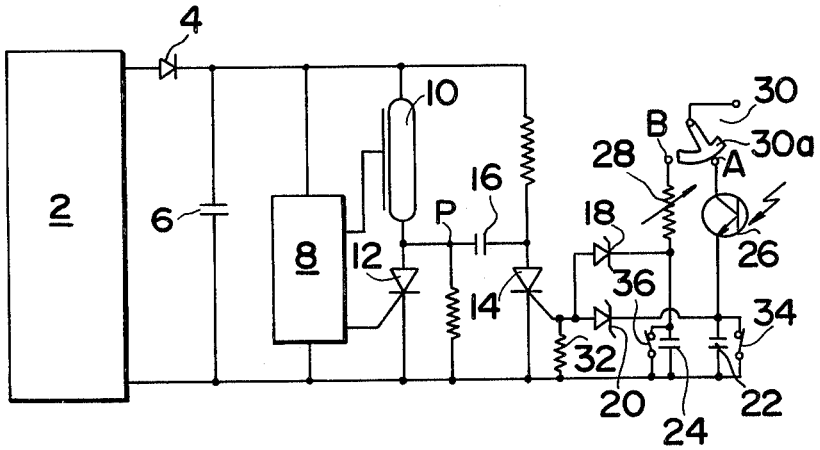
FIG. 1 is a circuit diagram of one embodiment of the invention.

Referring to FIG. 1, which shows one embodiment of the invention, power source circuit 2 includes a known blocking oscillation circuit and the like (not shown) and produces a high voltage at its output terminal. As a result, main capacitor 6 is charged with a high voltage, through rectifying diode 4. Trigger circuit 8 includes a known trigger capacitor, trigger transformer, trigger switch and the like (not shown) and produces a trigger voltage at trigger electrode 9 in flash tube 10. A second output actuates switch element 12, for example a silicon controlled rectifier (SCR) which is connected in series with flash tube 10, thereby enabling the firing of flash tube 10 with the discharge current from main capacitor 6. SCR 14 and commutation capacitor 16 constitute a control circuit for turning off switch element 12.

Photoconductive element 26, such as for instance, a phototransistor, produces a photo-current commensurate with the intensity of light from an object, and constitutes a first time-constant circuit with capacitor 22. Manually variable resistor 28 forms a second time-constant circuit with capacitor 24. Constant voltage elements 18, 20, for example zener diodes, provide a current to resistor 32, when a reverse voltage of a higher level than a given level, i.e., the break-over voltage (zener potential), is impressed thereon, so that SCR 14 is made conductive.

Change-over switch 30 permits three kinds of connections, i.e., (i) a connection of movable contact 30*a* to terminal A only, (ii) a connection of movable contact 30*a* to both terminals A and B, and (iii) a connection of movable contact 30*a* to terminal B only.

Short-circuiting switches 34, 36 respectively connected in parallel with capacitors 22, 24 are opened in synchronism with a trigger switch in trigger circuit 8. In a commercial adaptation, short-circuiting switches 34, 36 are composed of a switching circuit or a semiconductive switch element which turns off in response to the generation of a trigger voltage in trigger circuit 8, as a result of a terminal voltage drop across main capacitor 6, or emission of a flash from flash tube 10.

With the circuit of the aforesaid arrangement, in the case where movable contact 30a is only connected to terminal A, when trigger circuit 8 is actuated to fire flash tube 10, and, simultaneously therewith short-circuiting switch 34 is opened, then capacitor 22 is charged with the photocurrent from photoelectric element 26. When the terminal voltage of capacitor 22 reaches the zener potential of zener diode 20, then current flows through zener diode 20 to resistor 32, thereby making SCR 14 conductive. As a result, commutation capacitor 16 is discharged, so that the potential at point P is abruptly changed from a zero potential to a negative potential, thereby reverse-biasing and blocking switch element 12. Thus, flash tube 10 is open-circuited and prevented from conducting and is extinguished. Thus, in accordance with the above operation the amount of light may be automatically adjusted commensurate with the amount of light reflected by an object.

In the case where movable contact 30a is only connected to contact B, then the adjustment of the amount of light from flash tube 10 is carried out commensurate with the resistance of variable resistor 28 in substantially the same manner as the preceding case. However, SCR 14 is made conductive as a result of the voltage across capacitor 24 exceeding the zener breakdown voltage of zener diode 18.

When flash tube 10 is triggered, with movable contact 30a being connected simultaneously to both contacts A and B, short-circuiting switches 34, 36 are opened in response thereto, or in cooperation therewith, so that capacitors 22, 24 are respectively charged with the photocurrent from photoelectric element 26 and the current through the resistance of variable resistor 28. Then, when the terminal voltage across either one of capacitors 22, 24 reaches a given level, i.e., the breakover voltage of zener diodes 20, 18, respectively, then current flows through resistor 32, thereby making SCR 14 conductive and shutting off switch element 12. In other words, the flashing of flash tube 10 is interrupted by the discharge of either one of capacitors 22, 24 in dependence upon which capacitor first reaches the break-over voltage of zener diode 20, 18, respectively.

Accordingly, with high speed continuous photography, if the resistance of variable resistor 28 is set so that the amount of light from flash tube 10 is small enough for the recharging time of main capacitor 6 to match the continuous photography cycle, the amount of light from flash tube 10 is controlled by means of photoelectric element 26. Such is the case when the required amount of light from flash tube 10 is small because of a short object distance. However, in the case when the recharging time of main capacitor 6 is expected to be too long to be matched with the continuous photography cycle, because of a long object distance and the insufficient total amount of light from flash tube 10 (i.e. a small guide number of the flash device), the amount of light from flash tube 10 is controlled by means of variable resistor 28. It is advantageous for the photographer if the resistance of variable resistor 28 is adjusted by the frame-number setting means for continuous photography for adjusting the amount of light from the flash tube for high speed continuous photography. In that case, the maximum allowable charging time for the main capacitor is the photographic cycle time less the flashing duration of the flash tube.

Figure 2:
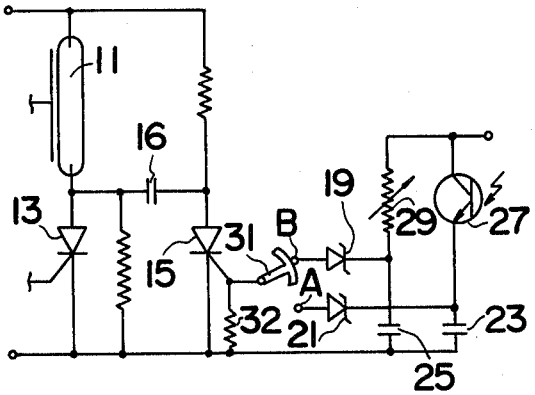
FIG. 2 and FIG. 3 are circuit diagrams of essential parts of other embodiments of the invention.

FIG. 2 shows the essential components of another embodiment of the invention, wherein like components corresponding to those of FIG. 1 are designated with the next odd reference numerals of the even-numbered components of FIG. 1. The difference between the embodiments shown in FIGS. 1 and 2 lies in the position of the change-over switch. Change-over switch 31 is positioned between resistor 32 and constant voltage elements 18, 20 in the embodiment of FIG. 2, although the operation of this circuit is the same as that of the circuit of FIG. 1.

Figure 3:
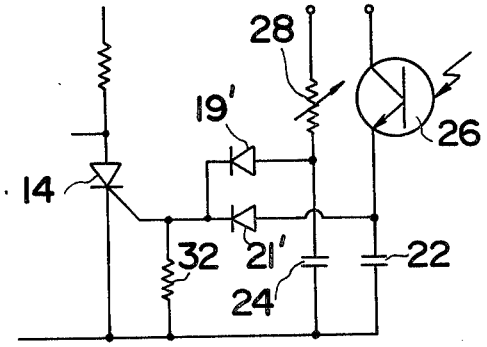

Alternatively, ordinary type diodes 19', 21' may be connected in the forward direction between the time constant circuit and the control circuit as shown in FIG. 3, in place of constant voltage elements 18, 20 of FIG. 1.

What is claimed is:

1. Control circuitry for terminating flash output from a flash device coupled with a camera having a driving means for high speed continuous photography, said control circuitry comprising:

a first time constant circuit having a time constant depending on the amount of light reflected from an object illuminated by said flash device;

a second time constant circuit including a variable circuit element adjustable in accordance with the photographic cycle of high speed continuous photography;

a control circuit responsive to said first and second time constant circuits for interrupting the current through said flash device when the output of either said first or said second time constant circuit reaches a predetermined level, said second time constant circuit limiting the duration of flash firing such that the charging time of the flash device is synchronized with said photographic cycle; and a change-over switch having a first position for simultaneously actuating both said first and second time constant circuits, and second and third positions for respectively actuating said first and said second time constant circuits.

2. Control circuitry as in claim 1 wherein said first time constant circuit includes a means for determining the intensity of light reflected from an object and a first capacitor connected in series therewith, and said variable circuit element is a manually variable resistance connected in series with a second capacitor; and further comprising an OR gate for gating the respective charging voltages of said first and second capacitors to said control circuit.

3. Control circuitry as in claim 2 wherein the resistance of said manually variable resistance is varied in accordance with the setting of a frame setting member for continuous photography.

4. Control circuitry as in claim 3 further comprising a power source and said change-over switch includes a movable contact connected to said power source such that both said first and second time constant circuits are connected to said power source with said change-over switch in said first switching position, and said first and second time constant circuits are respectively connected to said power source with said change-over switch in said second and third positions, respectively.

5. Control circuitry as in claim 2 wherein said means for controlling further includes a second switching element and a commutation capacitor discharged upon actuation of said second switching element for deactuating said means for switching, and first and second constant voltage elements respectively connected between said first and second capacitors and said second switching element for providing respective voltage signals for deactuating said second switching element.

6. Control circuitry as in claim 5 wherein said first and second constant voltage elements are zener diodes.

7. Control circuitry as in claim 5 wherein said first and second constant voltage elements are diodes.

8. Control circuitry as in claim 1 wherein said change-over switch is connected between said control circuit and said first and second time constant circuits.

9. Control circuitry for terminating flash output from a flash device coupled with a camera having a driving means for high speed continuous photography, said control circuitry comprising:

a first time constant circuit having a time constant depending on the amount of light reflected from an object illuminated by said flash device;

a second time constant circuit including a variable circuit element adjustable in accordance with the photographic cycle of high speed continuous photography;

a control circuit responsive to said first and second time constant circuits for interrupting flash firing when the output of either said first or said second time constant circuit reaches a predetermined level, said second time constant circuit limiting the duration of flash firing such that the charging time of the flash device is synchronized with said photographic cycle; and a control mode selection means settable to a first condition for simultaneously actuating both said first and second time constant circuits, and to second and third conditions for respectively actuating said first and said second time constant circuits.

10. Control circuitry as in claim 9 wherein said first time constant circuit includes light detecting means and a capacitor to be charged with the current output of said light detecting means, and said control mode selection means includes means for selectively deactuating said light detecting means.

11. Control circuitry as in claim 9 wherein said control mode selection means includes switch means for selectively connecting both or either of said first and second time constant circuits in the circuitry.

12. Control circuitry as in claim 9 further comprising a power source and wherein said control mode selection means includes switch means for selectively connecting both or either of said first and second time constant circuits with said power source.

13. Control circuitry as in claim 9 wherein said control circuit includes a semiconductor switch means connected in series with the flash tube of said flash device.

* * * * *